166-307 SR

7/21/81 XR 4,279,304

United States Patent [19]

Harper

[11] 4,279,304

[45] Jul. 21, 1981

[54] WIRE LINE TOOL RELEASE METHOD

[76] Inventor: James C. Harper, Rte. 7, Box 59, Houma, La. 70360

[21] Appl. No.: 114,750

[22] Filed: Jan. 24, 1980

[51] Int. Cl.[3] ..... E21B 31/03

[52] U.S. Cl. ..... 166/301; 166/63; 166/65 R; 166/169; 166/307

[58] Field of Search ..... 166/301, 99, 63, 169, 166/162-164, 307, 65 R

[56] References Cited

U.S. PATENT DOCUMENTS

| | | | |
|---|---|---|---|
| 1,568,027 | 12/1925 | Swan . | |
| 2,139,076 | 12/1938 | Gates . | |
| 2,167,445 | 7/1939 | Brown . | |
| 2,308,361 | 1/1943 | Fearon . | |
| 2,631,673 | 3/1953 | Halderson et al. | 166/169 X |
| 2,900,026 | 8/1959 | Trusheim | 166/301 |
| 3,024,843 | 3/1962 | Hanes | 166/63 |
| 3,104,707 | 9/1963 | Overly . | |
| 3,217,802 | 11/1965 | Reddie et al. | 166/301 |
| 3,800,876 | 4/1974 | Eggleston | 166/301 |
| 4,166,500 | 9/1979 | McPhee | 166/169 X |

OTHER PUBLICATIONS

Oil Base, Inc., Bulletin, "SFT Sets Pipe Free", 5 pp.

Dresser-Magcobar, Drilling Fluids Product Data Memorandum, No. 1122, Nov. 11, 1969, one p.

Baker Oil Tools, Inc., "Operating Instructions, Wire Line Pressure Setting Assembly and Firing Head", Unit No. 3154, Aug. 15, 1977, 3 pp.

*Primary Examiner*—Stephen J. Novosad

*Attorney, Agent, or Firm*—Murray Robinson; Ned L. Conley; David Alan Rose

[57] ABSTRACT

A wire line well tool is connected to a fluid gun which is run into the hole along with the tool. Should the tool become stuck, the gun is actuated, e.g. electrically, to direct mud active fluid around the stuck tool and the inside of the well bore, to destroy the pressure imbalance about the tool and to exert a radial force pushing the tool toward the center of the hole to free same.

15 Claims, 2 Drawing Figures

WIRE LINE TOOL RELEASE METHOD

BACKGROUND OF THE INVENTION

This invention relates to wells, and more particularly, to a method of operating wire line tools to provide for tool release in case of the tool becoming stuck in the well bore.

Previously, when a wire line tool has become stuck in the well bore, it has been the practice to fish the tool out by running pipe in the bore down to the level of the tool, washing away the mud cake in which the tool had gotten stuck, and if the tool remained stuck, retrieving the tool with some device run on the pipe such as an overshot. Compare U.S. Pat. No. 1,858,500—Hinderliter.

In connection with stuck drill pipe and drill collars, when the pipe or collar has become stuck, a variety of methods of releasing the pipe or collar have been employed. For example, the pipe string may be cut off above the stuck point, e.g. with a tool as shown in U.S. Pat. No. 2,167,445—Brown and the free part of the string withdrawn. Thereafter, the remaining stuck pipe can be washed over and then pulled out with a spear or overshot. See for example the disclosure of U.S. Pat. No. 3,800,876—Eggleston. Hydraulic methods of releasing the pipe or collar have been suggested. See for example the disclosures of U.S. Pat. Nos.:

| | |
|---|---|
| 1,568,027 | Swan |
| 2,139,076 | Gates |
| 2,808,887 | Erwin |
| 3,096,822 | Hall |
| 3,104,707 | Overly |
| 3,236,307 | Brown |

It is also known, in the case of stuck pipe (or collars), to introduce a mud active agent into the pipe and pump it to the level where the pipe or collar is stuck; many times the stuck pipe is released. Such a mud active agent may be an acid, e.g. H Cl, to decompose the mud, or a chemical that will shrink the mud particles and allow well liquid to penetrate the mud cake. In either case communication will be established around the pipe to the fluid in the well bore so that the hydrostatic pressure of the well liquid around the stuck tool will become balanced and the lateral pressure imbalance destroyed, thereby freeing the pipe or collar from side thrust pressing it against the side of the hole. Two stuck pipe freeing mud active agents are available to the trade under the tradenames Black Magic and Pipe Lax.

Mud active agents placed by circulating the drilling fluid through pipe are of course unavailable for retrieval of wire line tools in the absence of any pipe through which the agent can be positioned. The total volume of mud in a well bore is too great to treat it all by dumping the agent down the hole. Also, it might be undesirable to change the character of the entire batch of drilling fluid. On the other hand, freeing of stuck wire line tools by washing over and fishing requires the expense of running in drill pipe.

Summary of the Invention

According to the invention, when a wire line tool, such as an electrical logging tool, is run into a well bore, there is attached to the tool a fluid gun which is run into the well bore along with the tool. Should the tool become stuck, the gun is actuated, e.g. electrically, to direct mud active agent, usually a liquid, around the stuck tool and the sides of the bore hole about the stuck tool, to put the sides of the tool equally in communication with the fluid in the well bore, thereby to destroy the pressure imbalance about the tool, and to exert a radial force pushing the tool toward the center of the hole.

Brief Description of the Drawing

For a detailed description of a preferred embodiment of the invention, including apparatus for performing the method thereof, reference will now be made to the accompanying drawings wherein.

The drawings are to scale and the conventions of the U.S. Patent and Trademark Office with respect to showing materials in patent cases have been employed, from which it will be seen that all parts are metal, e.g. steel, except for the elastomer seals, the copper electric conductors, and their insulation, the powder of the fuel charge, the damping oil, the mud active fluid, and the brass pressure plugs.

Description of Preferred Embodiment

Figure 1:
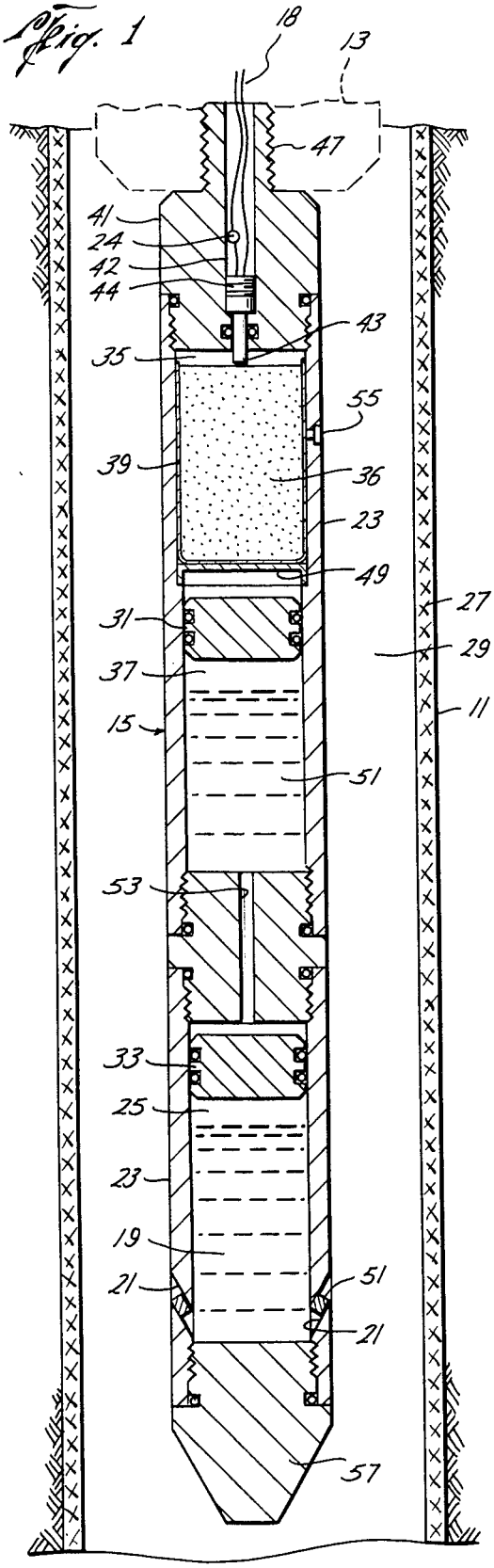
FIG. 1 is an axial section through a gun for carrying out the invention, with a schematic showing of an attached wire line tool, the assembly being shown in position in a well bore.

Referring now to FIG. 1, there is shown a well bore 11, within which is disposed a wire line well tool 13 to the lower end of which is connected a gun 15, this apparatus being according to the invention. Well tool 13 may for example be an electrical well logging tool such as illustrated by U.S. Pat. Nos.:

| | |
|---|---|
| Re 23226 | Bender |
| 2308361 | Fearon |
| 2390433 | Fearon |
| 2554844 | Swift |
| Re 24226 | Fearon |
| 2686266 | Pringle |

and perhaps other patents in U.S. Patent and Trademark Office Class 73, subclass 152.

Figure 2:
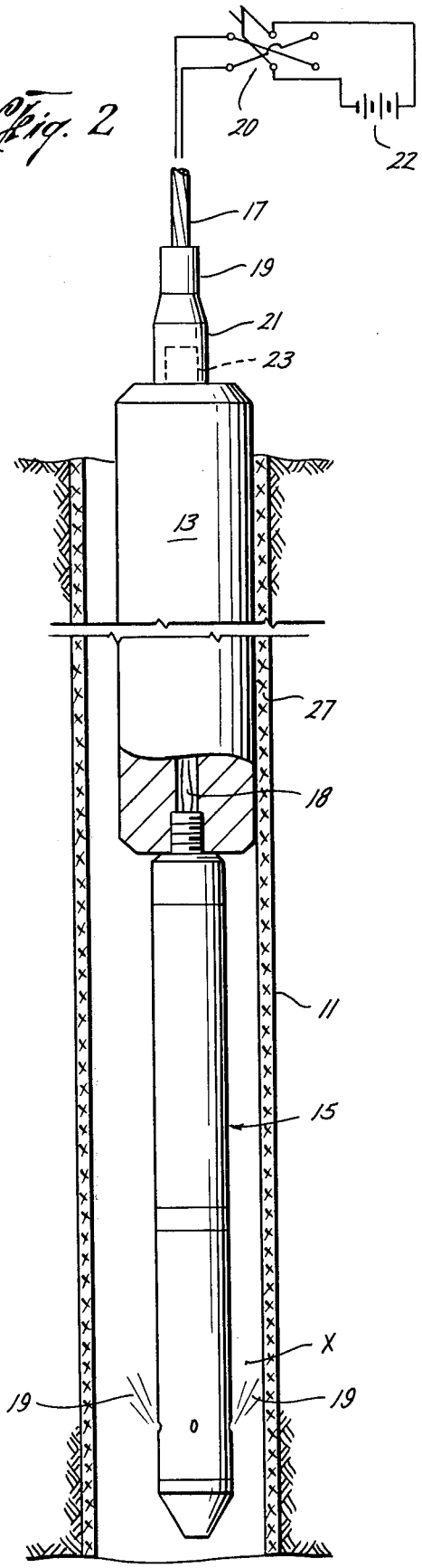
FIG. 2 is a view similar to FIG. 1 showing the apparatus stuck in the hole, i.e. pressed against one side of the well bore, and illustrating the gun in actuated condition.

Referring to FIG. 2, it is seen that tool 13 is suspended in the well bore by an electric cable 17, the mechanical load taking portion of which connects to rope socket 19. Socket 19 has a threaded box 21 which receives a threaded pin 23 at the upper end of tool 13. Electrical conductors from cable 17 pass through rope socket 19; some of the electrical conductors connect to parts in well tool 13 and others extend out the lower end of tool 13 into gun 15, a bundle of such conductors being indicated at 18.

As shown in FIG. 2, tool 13 may become lodged against one side of well bore 11 and resist axial motion up or down the well bore; in other words, tool 13 may become stuck in the well bore. The tool may become stuck so tightly that efforts to raise or lower it with the cable, even with the aid of jars, are to no avail. Since the tool must be freed and removed if the well bore is to be used without expensive reworking, it is important to provide an easy way to release the tool.

Typically there will be two conductors in cable 17, one being at ground potential and the others (hot line) at a positive or negative potential according to the position of reversing switch 20 that connects the conductors to battery 22. Each of the two conductors will fork inside the tool, one fork of each conductor going to the tool for actuation thereof and one fork of each conductor going to the gun for firing the gun. Oppositely directed diodes are in series with each hot line fork, such as diode 24 in the hot line fork going to gun 15, make it possible selectively to actuate the tool or fire the gun according to how switch 22 is closed.

According to the invention the release of the stuck tool is effected by actuation of gun 15 which was run into the hole along with tool 13 in anticipation of just such problem. Actuation of gun 15 effects a radial outward and upward discharge of mud active fluid 19 through ports 21 in the sides of the lower part of barrel 23 of the gun, such fluid having previously been stored in chamber 25 in the lower part of the gun barrel. The discharge of the mud active fluid will tend to center the gun in the well bore, due to greater pressure buildup at the side of the gun nearest to the side of the hole. In addition, and more importantly, the mud active fluid is directed upwardly toward stuck tool 13, where it acts upon the mud to free the tool. The mud active fluid will act on the mud cake 27 adjacent and around tool 13 and allow well fluid 29 in the well bore to flow between the tool and hole, equally, or nearly enough to equally, on all sides, to relieve the hydrostatic side thrust on the tool, whereupon it is freed to be lifted out of the hole by wire line cable 17.

Referring once more to FIG. 1, gun 15 includes, besides tubular barrel 23, upper and lower free pistons 31, 33 dividing the barrel into upper or fuel chamber 35, middle or oil chamber 37, and the previously mentioned lower or storage chamber 25. In the fuel chamber there is a solid fuel (powder cake) charge 36 contained in an open top plastic material cap 39 extending down from top closure 41. Electrical fuze booster igniter 43 extends down to adjacent the top of fuel charge 36 and is connected to the previously mentioned conductor cable 18 extending down through an axial passage 42 in top closure 41. Igniter 43 is sealed to closure 41 by an O ring and is held in place by a seal screw plug 44.

Somewhat similar constructions employing electrically ignited fuel for generating gas pressure in a wire line tool are disclosed in U.S. Pat. Nos.:

| | |
|---|---|
| 3,024,843 | Hanes |
| 3,139,930 | Hudgins, Jr. et al |
| 3,298,437 | Conrad |

and in publications in print as follows:

| | |
|---|---|
| Unit No. 3154 | August 15, 1977 (Baker Oil Tools, Inc.) esp. pp 2 and 3: "Operating Instructions, Wire Line Pressure Setting Assembly and Firing Head" |
| Chemical Cutter | 10/78 (Dresser-Atlas) |
| Pressure Setting Tools | Gearhart-Owen |
| (Page 1a/1977 | "Multistage" Wire Line Pressure Setting Tools) |
| (Page 1/1977 | "Shorty" Wireline Pressure Setting Tools) |

-continued

| | |
|---|---|
| (Page 5/1978-1 | "3½" O.D. "Shorty" Setting Tool) |

Top closure 41 has an externally threaded pin 47 at its upper end which screws into a threaded box in the lower end of wire line tool 13. Top closure 41 is screwed into the upper end of barrel 23 and sealed thereto by O-rings as shown. At the lower end of fuel charge 36 is a rupturable diaphragm 49 which supports the fuel charge. Preferably diaphragm 49 is omitted, charge 43 resting on top of piston 31.

In middle chamber 37 below free piston 37 is held a body 51 of lubricating oil. In view of the fact that the oil may become heated when the gun is lowered into a well bore, chamber 37 is not initially completely filled, leaving some room for expansion. The lower end of chamber 37 is closed except for an orifice 53.

In operation, if tool 13 becomes stuck, an electric switch at the upper end of cable 19 is closed in the proper direction, sending an electric current from battery 157 down cable 17 and conductors 18 to set off fuze 43. This ignites fuel charge 36 whose burning creates a gas. The pressure of the gas on piston 31 drives it down, forcing oil 51 through damping orifice or restriction 53. (Compare the Gearhart-Owen tools, supra). Oil from orifice 53 builds up above piston 33, forcing it down against mud active agent 19. (Compare the Dresser—Atlas Chemical Cutter, supra). When the pressure in chamber 25 rises high enough, pressure plugs 51, initially closing orifices 21 (as shown in FIG. 1) are forced out. The mud active agent is then discharged under pressure through ports 21, as shown in FIG. 2.

Due to the upward tilt of ports 21, the agent is directed upwardly, placing the agent in the mud cake in which the tool is stuck and tending to wash the cake away. At the same time, build-up of pressure of the agent between the gun and the near side of the hole (area shown at X in FIG. 2) tends to center the gun and attached tool, thereby to break it away from the mud cake.

After the tool has been released and withdrawn from the well bore, before it is run into the hole again gun 15 must be recharged, reloaded, reset, and rearmed. Initially, the gun will be depressurized by bleeding off products of combustion. To that end a cap screw 55 closing a port in chamber 35 may be removed. The top closure 41 can be unscrewed from barrel 23 and reloaded with another fuel charge and rearmed with another fuze. Barrel 23 can be recharged with mud active agent by introducing same through ports 21, following which ports 21 will be closed with brass pressure plugs 51, same being cylindrical bodies that can be pressed, driven, or screwed into cylindrical ports 21.

Instead of pressure plugs, rupture discs or other pressure responsive valve means could be employed. If desired, barrel 23 can be made of several parts, as shown, screwed together and sealed by O-rings so that it can be disassembled to facilitate refurbishing the gun after each actuation.

Pistons, 31, 33, can be placed in and removed from barrel 23 through either end of the barrel. The lower end of the barrel is closed by a threaded bull plug 57, which can be removed whenever desired. The lower end of plug 57 is tapered to help guide the gun and tool as they are lowered into the well bore.

The gun may be made of any suitable diameter, e.g. 1½ inches to 6 inches or more, to work with most any size wire line tool. As shown, the gun has a smaller diameter than the tool so that mud active fluid can better be directed toward the stuck side of the tool.

If desired, the gun could be placed above the wire line tool instead of below it, with the ports 21 directed downwardly instead of upwardly, but since provision would need to be made for running the electric cable to the wire line tool through the gun, it is preferable to place the gun under the tool. Guns could also be placed both above and below the wire line tool, or at intervals along the length of the tool.

Although it has been previously disclosed that ancillary equipment employing fuel burners may be run into a hole along with some other tool, as shown by U.S. Pat. Nos.:

| | | |
|---|---|---|
| 2,672,934 | Miner | Packer run on pipe with Sand Blaster |
| 3,465,356 | Porter | Wire Line Logging tool and Gas Thruster - Unit |
| 3,937,278 | Sheshtawj | Free Well Survey tool and Jet Propulsion and Float Actuation Unit, |

none of this prior art teaches that a quantity of mud active agent is to be associated with a wire line tool when it is run into the hole, the mud active agent to be released when the tool is stuck in the hole, such release being effected by sending an electric signal from above ground down the wire line and through the tool to a gun loaded with such mud active agent.

Any suitable mud active agent may be employed in carrying out the invention. Further information relative to the aforementioned Black Magic and Pipe Lax agents may be had by referring to the Composite Catalogue of Oilfield Equipment and Service, 33rd revision, 1978–79, published by World Oil, Black Magic Supermix SFT being described at page 5137 thereof, and Pipe Lax being described at page 2265 thereof, and to available published patent and technical data sheet material thereon such as that accompanying this application. SFT acts not only to dislodge the existing mud cake by means of its surfactant, but substitutes a new mud cake that has less water loss to the formation and a higher lubricity, all desirable factors in a mud active agent. If it is desired to decompose the existing mud cake, e.g. with an acid, an aqueous solution of hydrochloric acid may be employed, e.g. a concentrated solution of, e.g., 40% acid by weight. Acids used in acid fracture treatment of wells to increase fluid production may be employed. A discussion of mud treatment chemicals generally, including mud thinners, is to be found in:

Rotary Drilling Handbook
Sixth Edition (1961)
published by Palmer Publications (see pages 267–270)

Copies of these pages accompany this application.

I claim:

1. Method of operating a wire line tool in an earth bore hole to enable the tool to be freed in case the tool gets stuck in the hole, and to free the tool in the event the tool becomes stuck in the hole, comprising;

associating with the tool a quantity of mud active agent to be released if the tool gets stuck, running said agent into the hole along with the tool, and upon the tool becoming stuck, releasing the mud active agent;

wherein the mud active agent is initially stored in a gun loaded with fuel and the agent is released by igniting the fuel to produce combustion product pressure to force the agent out of the gun.

2. Method according to claim 1 wherein the mud active agent is active to remove wall cake adjacent the stuck point.

3. Method according to claim 2 wherein the mud active agent contains hydrochloric acid to dissolve the mud cake.

4. Method according to claim 2 wherein the mud active agent contains a surfactant to break down the mud cake.

5. Method according to claim 4 wherein the mud active agent further includes a substitute wall caking material having a low fluid loss.

6. Method according to claim 4 wherein the mud active agent further includes a lubricant.

7. Method according to claim 1 wherein the mud active agent when released is directed toward the sides of the wire line tool.

8. Method according to claim 1 wherein the mud active agent is released in a plurality of radial directions equally spaced apart circumferentially whereby agent pressure builds up in the smaller volume sectors about the tool where it is closer to the hole wall, thereby to center the tool.

9. Method according to claim 1 wherein the mud active agent is initially below the tool and when released is directed upwardly and outwardly.

10. Method according to claim 1 wherein the gun is connected electrically to the wire line on which the tool is run and the mud active agent is released by transmitting an electric signal to the gun through the wire line.

11. Method according to claim 10 wherein the gun is located below the tool and the electric signal is transmitted to the gun through the tool, and the mud active agent when released is directed upwardly.

12. Method according to claim 1 wherein the mud active agent is initially stored in a chamber having pressure actuated vents and the agent is discharged by building up the pressure in the chamber to a point sufficient to activate the vents to open condition.

13. Method according to claim 1 wherein the products of combustion pressure is imposed on the mud active agent through a damper.

14. Method according to claim 1 wherein the mud active agent has an aqueous affinity greater than that of the hole formation by virtue of the presence in the agent of sufficient calcium chloride, whereby water is withdrawn from shale in the formation to cause same to shrink away from the tool.

15. Method of operating a wire line tool in an earth bore hole to enable the tool to be freed in case the tool gets stuck in the hole, comprising:

charging a gun with fuel, loading the gun with a mud active agent active to break down wall cake, associating such wire line tool with the gun, and running the tool and gun together into such hole on a wire line, said gun being operable upon ignition of said fuel to produce combustion product pressure to force the mud active agent out of the gun for the purpose of releasing the tool in case the tool gets stuck.

* * * * *